US009280112B2

(12) United States Patent
Akimoto

(10) Patent No.: US 9,280,112 B2
(45) Date of Patent: Mar. 8, 2016

(54) PRINTING APPARATUS, CONTROL METHOD FOR CONTROLLING PRINTING APPARATUS, AND STORAGE MEDIUM

(71) Applicant: CANON KABUSHIKI KAISHA, Tokyo (JP)

(72) Inventor: Naoto Akimoto, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/792,480

(22) Filed: Jul. 6, 2015

(65) Prior Publication Data

US 2016/0011555 A1 Jan. 14, 2016

(30) Foreign Application Priority Data

Jul. 11, 2014 (JP) ..... 2014-143520

(51) Int. Cl.
*G03G 15/00* (2006.01)

(52) U.S. Cl.
CPC ..... *G03G 15/5016* (2013.01)

(58) Field of Classification Search
CPC ..... G03G 15/5016; G03G 15/50
USPC ..... 399/81, 82
See application file for complete search history.

(56) References Cited

U.S. PATENT DOCUMENTS 6,865,354 B2 * 3/2005 Jackelen et al. ..... 399/81
8,725,022 B2 * 5/2014 Kamata ..... 399/81

FOREIGN PATENT DOCUMENTS

JP 2005-350229 A 12/2005

* cited by examiner

*Primary Examiner* — Hoang Ngo
(74) *Attorney, Agent, or Firm* — Canon USA, Inc. IP Division

(57) ABSTRACT

A printing apparatus includes a storing unit, a printing unit, a receiving unit, and a controlling unit. The storing unit stores a size of a sheet. The printing unit prints an image on the sheet based on a specified print job sheet size. The receiving unit is configured to receive, from a user and before the printing, an instruction for notifying the user of an error where the specified print job sheet size does not match the stored sheet size. If the receiving unit receives the instructions and the specified print job sheet size does not match the stored sheet size, the user is notified of the error and the printing unit executes printing. If the receiving unit does not receive the instruction and the specified print job sheet size does not match the stored sheet size, the printing unit executes printing without notifying the user of the error.

14 Claims, 11 Drawing Sheets

FIG.6A

600

< ERROR >
THE SIZE OF THE SET SHEET DOES
NOT MATCH THE SPECIFIED SHEET.

THE PRINTING IS STOPPED.

FIG.6B

610

< ERROR >
THE SIZE OF THE SET SHEET DOES
NOT MATCH THE SPECIFIED SHEET.

DO YOU WANT TO CONTINUE
THE PRINTING?

YES
NO

FIG.7

700

| | 701 SHEET SIZE | 702 SHEET TYPE | 703 SHEET REMAINING QUANTITY | 704 DRIVER PRIORITY SETTING | 705 OPERATION AT THE TIME OF A SIZE MISMATCH |
|---|---|---|---|---|---|
| TRAY 1 | A4 | PLAIN PAPER | NO SHEET CONTAINED | ON | FORCIBLE PRINTING |
| TRAY 2 | A4 | PLAIN PAPER | SOME SHEET(S) CONTAINED | ON | FORCIBLE PRINTING |
| TRAY 3 | A4 | COLORED PAPER | SOME SHEET(S) CONTAINED | OFF | — |
| TRAY 4 | A3 | PLAIN PAPER | SOME SHEET(S) CONTAINED | ON | ERROR DISPLAY |
| MANUAL FEEDING TRAY | B4 | COATED PAPER | SOME SHEET(S) CONTAINED | ON | FORCIBLE PRINTING |

PRINTING APPARATUS, CONTROL METHOD FOR CONTROLLING PRINTING APPARATUS, AND STORAGE MEDIUM

BACKGROUND OF THE INVENTION

1. Field of the Invention

The present invention relates to a printing apparatus that executes printing, a control method for controlling the printing apparatus, and a storage medium.

2. Description of the Related Art

There are printing apparatuses that stop printing if a size of a sheet that is specified in a print job does not match a size of a sheet held in a sheet holding unit. Such a printing apparatus notifies a user that the user should supply sheets to be used in the printing into the sheet holding unit according to the stop of the printing.

Japanese Patent Application Laid-Open No. 2005-350229 discusses a printing apparatus that notifies a user of a message for requesting a sheet if the size of the sheet that is specified in the print job does not match the size of the sheet held in the sheet holding unit. This printing apparatus forcibly carries out printing according to the user's pressing of a specific switch, even when the size of the sheet that is specified in the print job does not match the size of the sheet held in the sheet holding unit.

The printing apparatus carries out printing if the size of the sheet that is specified in the print job matches a registered size of the sheet held in the sheet holding unit. Further, the printing apparatus stop printing if the size of the sheet that is specified in the print job does not match the registered size of the sheet held in the sheet holding unit. For example, if the size of the sheet that is specified in the print job is "A3" while the registered size of the sheet held in the sheet holding unit is "A4", the printing apparatus stop printing since these sizes do not match each other.

On the other hand, in some cases, the user may be aware of an actual size of the sheet held in the sheet holding unit. Such a situation arises, for example, when the user has replaced the sheet held in the sheet holding unit immediately before the printing. In this case, the printing apparatus can just carry out printing regardless of whether the size of the sheet that is specified in the print job matches the registered size of the sheet held in the sheet holding unit. This means that, for example, even when the size of the sheet that is specified in the print job is "A3" while the registered size of the sheet held in the sheet holding unit is "A4", the printing apparatus carries out printing according to the size (A3) of the sheet that is specified in the print job. However, the user cannot make a setting for causing the printing apparatus to carry out printing regardless of whether the size of the sheet that is specified in the print job matches the registered size of the sheet held in the sheet holding unit while associating this setting with the sheet holding unit before the printing apparatus carries out printing.

SUMMARY OF THE INVENTION

According to an aspect of the present invention, a printing apparatus comprises a storing unit configured to store a size of a sheet, wherein the sheet is held in a sheet holding unit, a printing unit configured to print an image on the sheet fed from the sheet holding unit based on a size of a sheet that is specified in a print job, a receiving unit configured to receive, from a user and before the printing unit executes printing, an instruction for notifying the user of an error in a case where the size of the sheet that is specified in the print job does not match the size of the sheet that is stored in the storing unit, and a controlling unit configured to perform control wherein, in a case where the instruction is received by the receiving unit and the size of the sheet that is specified in the print job does not match the size of the sheet that is stored in the storing unit, the controlling unit is configured to perform control to notify the user of the error and cause the printing unit to execute printing, and wherein, in a case where the instruction is not received by the receiving unit and the size of the sheet that is specified in the print job does not match the size of the sheet that is stored in the storing unit, the controlling unit is configured to perform control to cause the printing unit to execute printing without notifying the user of the error.

Further features of the present invention will become apparent from the following description of exemplary embodiments with reference to the attached drawings.

BRIEF DESCRIPTION OF THE DRAWINGS

FIGS. 6A and 6B illustrate screens according to the first exemplary embodiment.

FIG. 7 illustrates a table illustrating one example of setting values of trays according to the first exemplary embodiment.

DESCRIPTION OF THE EMBODIMENTS

Figure 1:
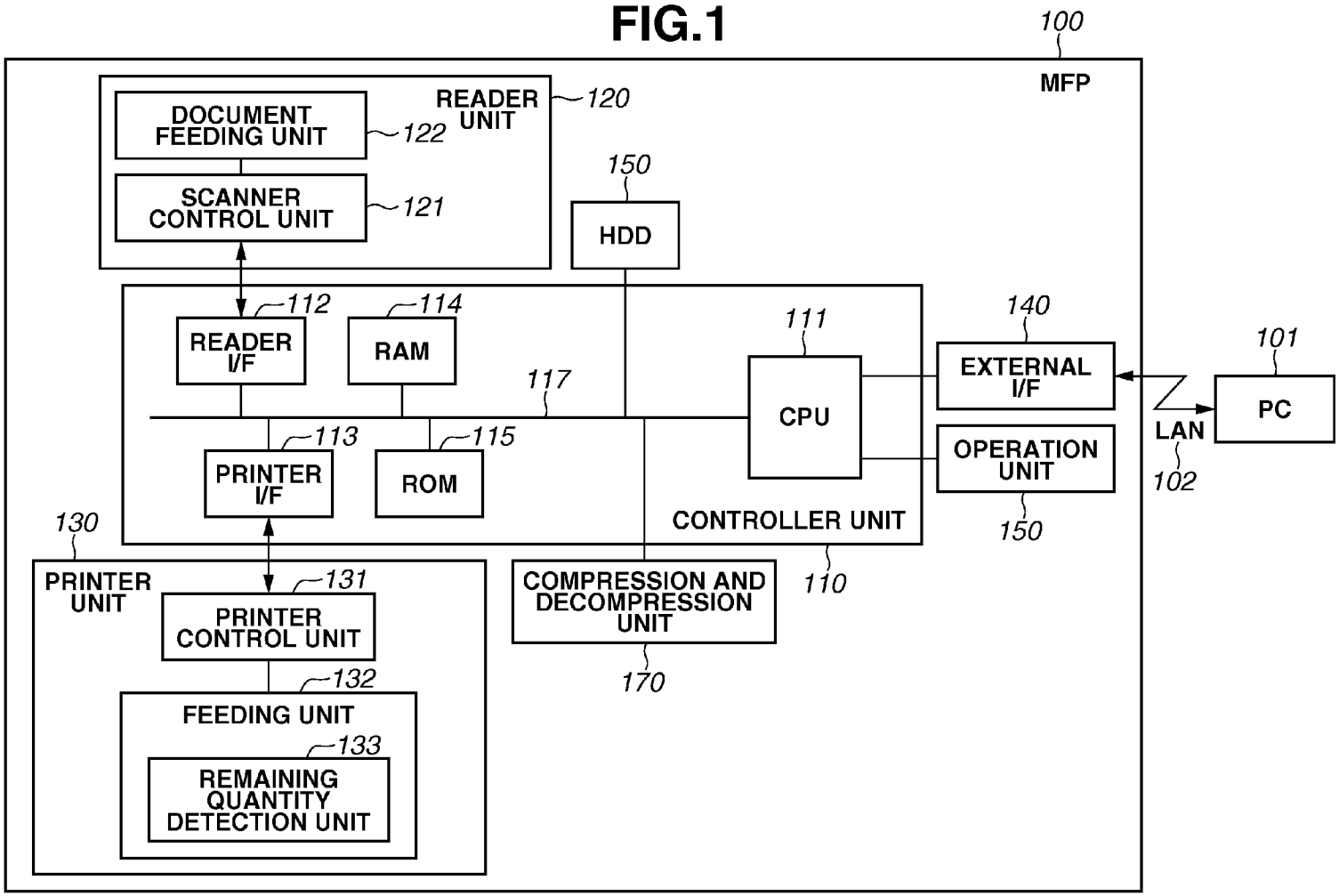
FIG. 1 is a block diagram illustrating a printing system according to an exemplary embodiment of the present invention.

In the following description, an exemplary embodiment of the present invention will be described in detail with reference to the accompanying drawings. However, the exemplary embodiment that will be described below does not limit the present invention defined according to the claims, and not all of combinations of features that will be described in the present exemplary embodiment are necessarily essential to a solution of the present invention.

A printing system according to a first exemplary embodiment of the present invention will be described with reference to FIG. 1.

In the first exemplary embodiment, a central processing unit (CPU) 111 of a controller unit 110 acquires a size of a sheet that is specified in a print job (e.g., specified by a printer driver). Further, the CPU 111 acquires a registered size of a sheet held in a tray that is supposed to feed a sheet to be used in the print job (hereinafter, referred to as a "tray that is used in the print job").

Further, the CPU 111 makes a setting that printing is to be carried out if the size of the sheet that is specified in the print job matches the registered size of the sheet held in the tray that is used in the print job while associating this setting with the tray that is used in the print job before the printing is carried out. Alternatively, the CPU 111 makes a setting that the printing is to be carried out without determining whether the size of the sheet that is specified in the print job matches the registered size of the sheet held in the tray that is used in the print job while associating this setting with the tray that is used in the print job before the printing is carried out. Then, the CPU 111 controls printing according to this setting associated with the tray that is used in the print job.

In the following description, details thereof will be described.

The printing system according to the present exemplary embodiment includes a multi function peripheral (MFP) 100, which is one example of a printing apparatus, and a personal computer (PC) 101, which is an external apparatus.

The MFP 100 has an image reading function of reading a document 202 and generating image data, and a printing function (copy function) of printing an image onto a sheet based on the generated image data. Further, the MFP 100 has a printing function (PC printing function) of receiving a print job from the PC 101 and printing a character and an image onto a sheet 201 based on this print job.

The MFP 100 is connected to the PC 101 via a network such as a local area network (LAN) 102, and communicates with the PC 101.

The PC 101 inputs a print job to the MFP 100 via a network such as the LAN 102. Then, the MFP 100 processes the print job input from the PC 101 via the network such as the LAN 102. Details of the print job will be described below with reference to FIG. 4.

The present exemplary embodiment will be described assuming that the MFP 100 and the PC 101 are connected to each other via the LAN 102 by way of example, but the connection between the MFP 100 and the PC 101 is not limited to this example. The MFP 100 and the PC 101 may be connected to each other via a wide area network (WAN), such as the Internet. Alternatively, the MFP 100 and the PC 101 may be connected to each other via a universal serial bus (USB) cable. Alternatively, the MFP 100 and the PC 101 may be configured to be capable of communicating with each other via a wireless communication, such as Wireless Fidelity (Wi-Fi) and Bluetooth (registered trademark).

Further, the PC 101 generates image data by application software, and transmits the generated image data to the MFP 100. The present exemplary embodiment will be described assuming that the external apparatus is the PC 101 as one example thereof, but the external apparatus may be a mobile information terminal such as a personal digital assistance (PDA) and a smartphone, a facsimile apparatus, a network connection apparatus, an external dedicated apparatus, or the like.

The MFP 100 includes the controller unit (controlling unit) 110, which will be described below, a reader unit 120, a printer unit 130, an external interface (I/F) 140, a hard disk drive (HDD) 150, an operation unit 160, and a compression and decompression unit 170. These units are disposed on a system bus 117 and are electrically connected, and transmit and receive a control command and data to and from one another. The external I/F 140 is one example of a communication unit, and is an interface that allows the MFP 100 to transmit and receive image data to and from the PC 101.

The reader unit 120 includes a scanner control unit 121 that controls communication with the controller unit 110, and a document feeding unit 122 that feeds the document 202. The reader unit 120 is instructed to read the document 202 from the controller unit 110 via the scanner control unit 121, and the reader unit 120 optically reads an image on the document 202 and converts the image into the image data as an electric signal. In the following description, the present exemplary embodiment will be described assuming that the reader unit 120 is instructed to read the document 202 from the controller unit 110 via the scanner control unit 121, but the issue of this instruction is not limited to this example. In a case where the reader unit 120 does not include the scanner control unit 121 as a component thereof, the reader unit 120 may be instructed to read the document 202 directly from the CPU 111 of the controller unit 110.

On the other hand, the printer unit 130 includes a printer control unit 131 that controls communication with the controller unit 110. Further, the printer unit 130 includes a feeding unit (sheet holding unit) 132 having a plurality of feeding trays 251 to 254 and a manual feeding tray 250 each hold the sheet 201 to be used in printing. The present exemplary embodiment will be described assuming that the feeding unit 132 is embodied by the feeding trays and the manual feeding tray included in the MFP 100 by way of example, but the feeding unit 132 may be embodied by a feeding deck included in a feeding device connected to the MFP 100. In the following description, the feeding trays 251 to 254 and the manual feeding tray 250 will be also collectively referred to as "trays 250 to 254".

Further, the printer unit 130 performs print processing for a print target job (print job) stored in the HDD 150 of the controller unit 110. The printer unit 130 is instructed to print the image data from the controller unit 110 via the printer control unit 131.

Then, the printer unit 130 transfers and fixes a toner image formed based on the image data onto the sheet 201 fed from the feeding unit 132, thereby forming (printing) an image onto the sheet 201 with use of toner (developing agent). The transfer and the fixing will be described below.

In the following description, the present exemplary embodiment will be described assuming that the printer unit 130 is instructed to print the image data from the controller unit 110 via the printer control unit 130, but the issue of this instruction is not limited to this example. In a case where the printer unit 130 does not include the printer control unit 131 as a component thereof, the printer unit 130 may be instructed to print the image data directly from the CPU 111 of the controller unit 110.

Further, the MFP 100 includes a nonvolatile memory such as the HDD 150 storing the print job, as one example of a storing unit. The HDD 150 stores a plurality of pieces of data such as system software, print data of the print job, and image data compressed by the compression and decompression unit 170, which will be described below. The present exemplary embodiment will be described assuming that the HDD 150 is used as a mass-storage and nonvolatile storage device by way of example, but a nonvolatile memory such as a solid state drive (SSD) may be used as long as the nonvolatile memory is the mass-storage and nonvolatile storage device.

The controller unit 110 has a plurality of functions. For example, the controller unit 110 stores the image data of the document 202 read by the reader unit 120 into the HDD 150. Then, the controller unit 110 can carry out a copy job of printing the image onto the sheet 201 by the printer unit 130 based on the image data read out from the HDD 150. Further, the controller unit 110 can carry out a scanner function of converting the image data of the document 202 read by the reader unit 120 into code data, and transmitting the converted code data to the PC 101 via the external I/F 140. Further, the controller unit 110 stores the print job received from the PC 101 via the external I/F 140 into the HDD 150. Then, the controller unit 110 carries out printing function of converting code data read out from the HDD 150 into the image data, and printing the image onto the sheet 201 by the printer unit 130 based on this image data.

Further, the controller unit 110 includes the CPU 111, a read only memory (ROM) 115, a random access memory (RAM) 114, a reader I/F 112, and a printer I/F 113.

The CPU 111 controls processing, operations, and the like of the reader unit 120, the printer unit 130, and various kinds of units (e.g., feeding unit 132) included in the MFP 100. The ROM 115 is a read-only memory, and stores a program such as a boot sequence and font information in advance. On the other hand, the RAM 114 is a readable and writeable memory, and stores the image data transmitted from the reader unit 120 and the external I/F 140, various kinds of programs, setting information, and the like.

The ROM 115 or the HDD 150 stores various kinds of control programs required to perform various kinds of processing and the like illustrated in flowcharts that will be described below, which are executed by the CPU 111. Then, the CPU 111 performs various kinds of operations according to the present exemplary embodiment by reading out the programs stored in the ROM 115 or the HDD 150 and loading these programs into the RAM 114.

Further, the ROM 115 or the HDD 150 also stores a display control program including a user interface screen (hereinafter, referred to as a UI screen) for displaying various kinds of UI screens on a display unit 301 of the operation unit 160, which will be described below with reference to FIG. 3. The CPU 111 performs various kinds of operations according to the present exemplary embodiment by reading out the program stored in the ROM 115 or the HDD 150 and loading this program into the RAM 114.

Further, the ROM 115 also stores, for example, a program for causing the CPU 111 to perform an operation of interpreting page description language (hereinafter, abbreviated as PDL) data received from the PC 101 via the external I/F 140, and rasterizing this data into raster image data (bitmap image data).

Similarly, the ROM 115 also stores, for example, a program for causing the CPU 111 to interpret the print job received from the PC 101 via the external I/F 140, and to process this job. These are processed by software.

The controller unit 110 stores (holds) a job to be processed as a processing target (e.g., print job) that is input via various kinds of input units such as the reader unit 120 and the external I/F 140, into the HDD 150. The job does not necessarily have to be stored into the HDD 150, and may be stored into the RAM 114.

Then, the controller unit 110 reads out the job to be processed as the processing target from the HDD 150, and performs various kinds of output processing for this job. For example, the controller unit 110 reads out the print job from the HDD 150, and outputs this print job to the printer unit 130, thereby carrying out printing. Further, the controller unit 110 also performs control to enable the job read out from the HDD 150 to be transmitted to the PC 101 via the external I/F 140.

The compression and decompression unit 170 has an image processing block that performs processing for compressing and decompressing the image data and the like stored in the RAM 114 or the HDD 150 by various kinds of compression methods such as Joint Bi-level Image Experts Group (JBIG) and Joint Photographic Experts Group (JPEG), and stores the image data back into the RAM 114. The image data compressed by the compression and decompression unit 170 can be transmitted to the PC 101 via the external I/F 140.

The controller unit 110 can receive the image data from the PC 101 via the external I/F 140. When storing the image data received via the external I/F 140 into the HDD 150, the controller unit 110 compresses this image data by the compression and decompression unit 170. On the other hand, when printing the image onto the sheet 201 based on the image data stored in the HDD 150, the controller unit 110 decompresses this image data by the compression and decompression unit 170.

The reader I/F 112 is an interface that allows the controller unit 110 to be connected to the reader unit 120, which is an image input device. On the other hand, the printer I/F 113 is an interface that allows the controller unit 110 to be connected to the printer unit 130, which is an image output device. The controller unit 110 converts and controls the image data synchronously and asynchronously via the reader I/F 112 and the printer I/F 113.

Figure 3:
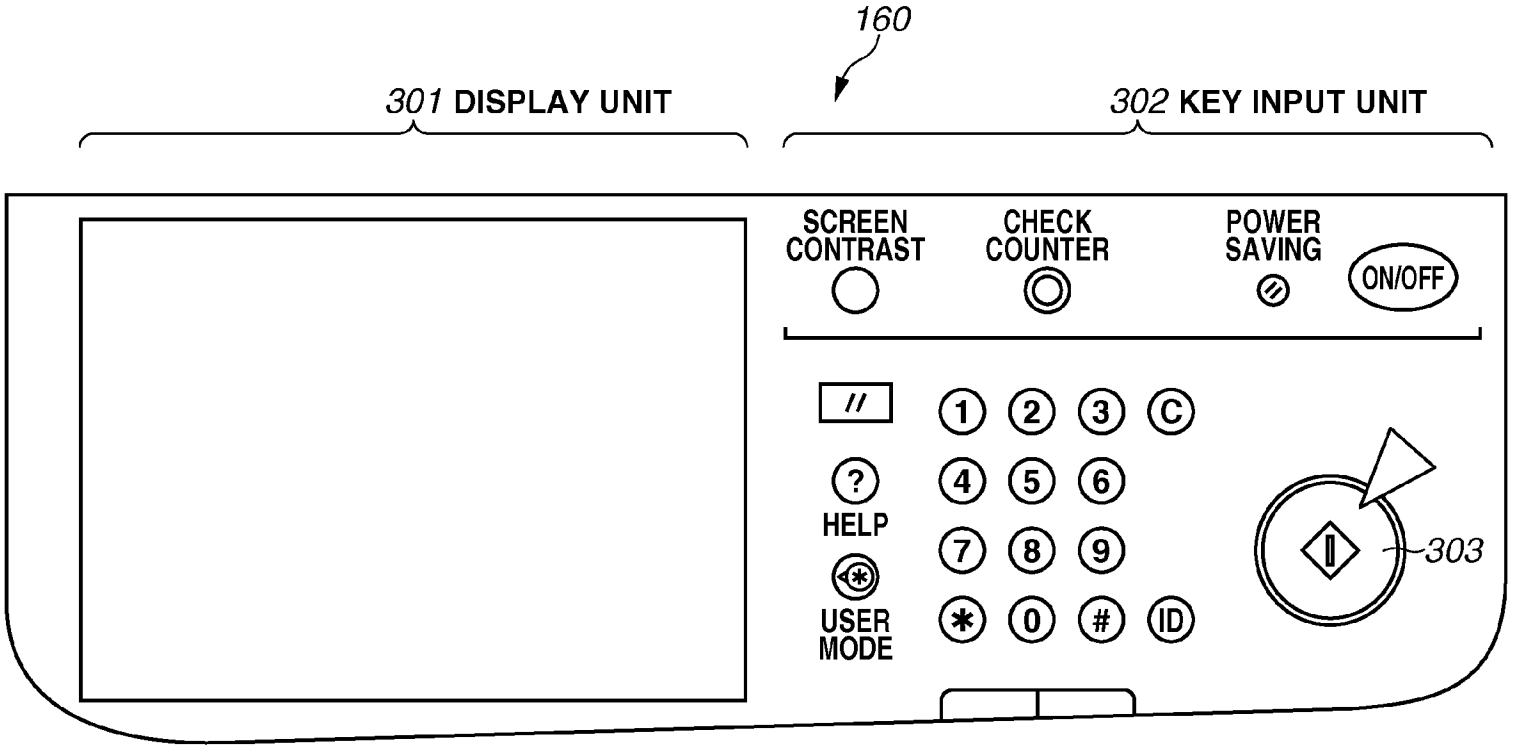
FIG. 3 is a top view of an operation unit of the MFP according to an exemplary embodiment of the present invention.

Further, the MFP 100 includes the operation unit 160 having the display unit 301 illustrated in FIG. 3, which corresponds to one example of a user interface unit. The operation unit 160 includes the operation unit 301 and a key input unit 302 as indicated in a top view illustrated in FIG. 3. Further, the operation unit 160 has a function of receiving various kinds of settings from a user via the display unit 301 or the key input unit 302. Further, the operation unit 160 has a function of providing information to the user via the display unit 301.

The display unit 301 includes a liquid crystal display (LCD), and a touch panel sheet having a transparent electrode (which may be the capacitive type) attached on the LCD. An operation screen is displayed on the LCD, and besides that, a state of the MFP 100 is also displayed on the LCD. On the other hand, the key input unit 302 includes a hard key. Examples of the hard key include a start key 303 for instructing the MFP 100 to carry out a job.

Figure 2:
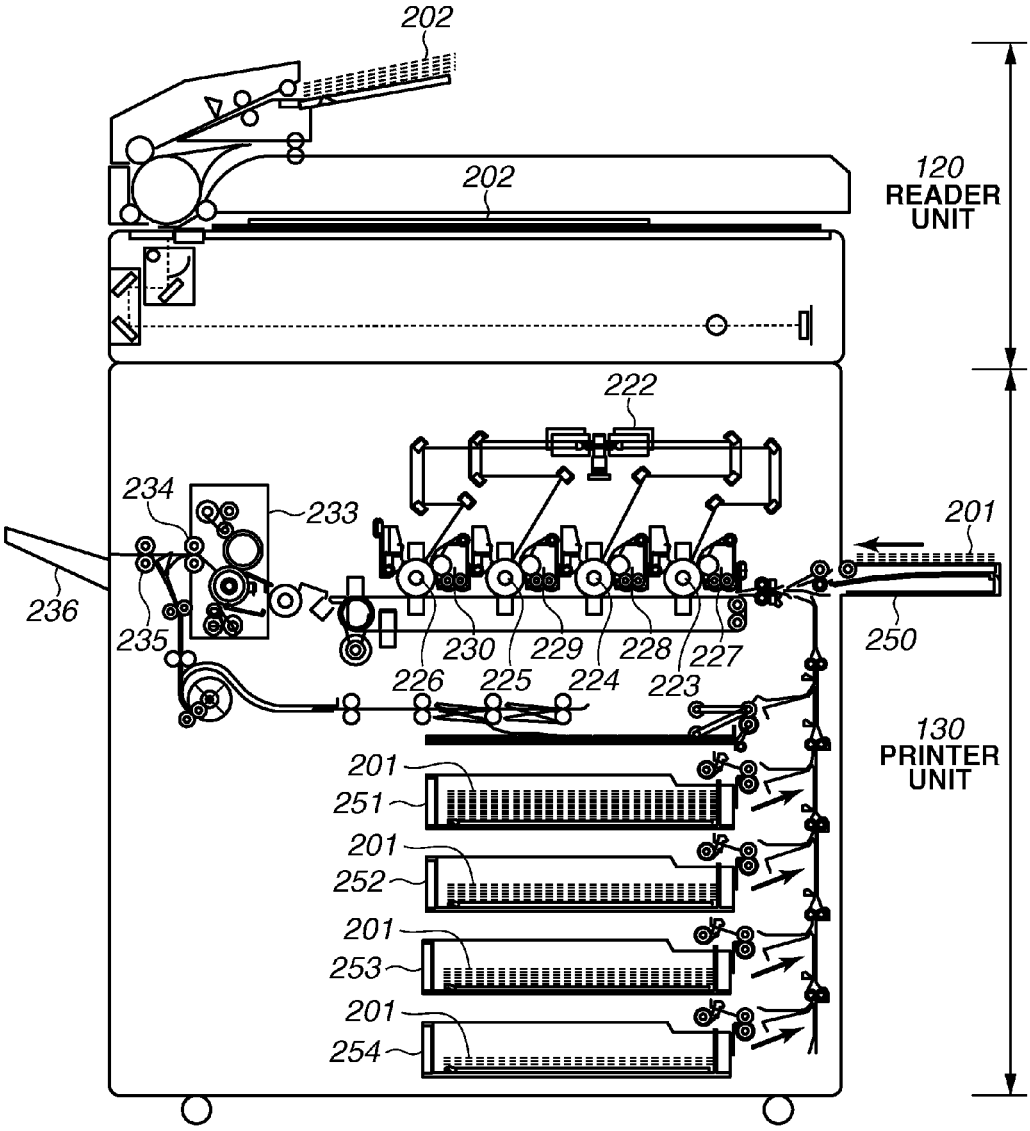
FIG. 2 is a cross-sectional view illustrating a configuration of a multi functional peripheral (MFP) according to an exemplary embodiment of the present invention.

FIG. 2 is a cross-sectional view of the reader unit 120 and the printer unit 130 illustrated in FIG. 1. In the following description, an operation of printing the image onto the sheet 201 based on the image data transferred to the printer unit 130 will be described.

The image data transferred to the printer unit 130 is converted into laser beams according to the image data by a laser unit 222. Then, this laser beams are emitted respectively onto photosensitive drums 223 to 226, and electrostatic latent images are formed on the photosensitive drums 223 to 226 according to the laser light. The toner is attached onto portions of the latent images on the photosensitive drums 223 to 226 by developing units 227 to 230. A color printer includes four photosensitive drums and four developing units for cyan, yellow, magenta, and black colors.

Further, the printer unit 130 includes the feeding trays 251, 252, 253, and 254, and the manual feeding tray 250 as sheet holding units included in the feeding unit 132. The feeding trays 251 to 254 each have a drawer-like form, and are configured to be attachable to and detachable from a main body of the MFP 100. The printer unit 130 may include a plurality of sheet feeding trays including the feeding tray(s) and the manual feeding tray(s), or may include at least any one of the feeding tray and the manual feeding tray. In the following description, the MFP 100 according to the present exemplary embodiment will be described assuming that the printer unit 130 includes the four feeding trays 251 to 254 and the single manual feeding tray 250 by way of example.

The feeding trays 251 to 254 can each hold a plurality of sheets 201 (e.g., 600 sheets). Further, the manual feeding tray 250 can hold a plurality of sheets 201 (e.g., 100 sheets).

The feeding unit 132 includes a remaining quantity detection sensor 133 for detecting a remaining quantity of the sheet(s) 201 held in each of the feeding trays 251 to 254. The remaining quantity detection sensor 133 is provided at each of the feeding trays 251 to 254. The remaining quantity detection sensor 133 may be provided at the manual feeding tray 250.

The controller unit 110 acquires information about the remaining quantity of the sheet(s) 201 that is detected by the remaining quantity detection sensor 133, and stores this information into the HDD 150. The information about the remaining quantity of the sheet(s) 201 that is stored in the HDD 150 is registered as a sheet remaining quantity 703 in a tray setting table 700 illustrated in FIG. 7.

Further, the controller unit 110 acquires a sheet size input by the user on the operation unit 160 as a size of the sheet 201 held in each of the trays 250 to 254, and stores the acquired sheet size into the HDD 150. The controller unit 110 may acquire the size of the sheet 201 held in each of the trays 250 to 254 by importing it from the PC 101, and store the acquired sheet size into the HDD 150. Information about the size of the sheet 201 that is stored in the HDD 150 is registered as an attribute value of a sheet size 701 in the tray setting table 700 illustrated in FIG. 7.

Further, the controller unit 110 acquires a sheet type input by the user on the operation unit 160 as a type of the sheet 201 held in each of the trays 250 to 254, and stores the acquired sheet type into the HDD 150. Examples of the sheet type include plain paper, thick paper, thin paper, coated paper, glossy paper, fine quality paper, and colored paper. The controller unit 110 may acquire the type of the sheet 201 held in each of the trays 250 to 254 by importing it from the PC 101, and store the acquired sheet type into the HDD 150. Information about the type of the sheet 201 that is stored in the HDD 150 is registered as an attribute value of a sheet type 702 in the tray setting table 700 illustrated in FIG. 7.

The printer unit 130 controls printing based on the sheet size 701 and the sheet type 702 stored in the HDD 150 as setting values of each of the feeding trays 251 to 254 and the manual feeding tray 250. For example, the printer unit 130 determines a feeding tray that should feed the sheet 201 from any of the feeding trays 251 to 254 based on the size of the sheet 201 that is specified in the print job at the time of the printing, and performs control in such a manner that the sheet 201 is fed from the determined feeding tray. Further, for example, the printer unit 130 controls a temperature of a fixing device and a conveyance speed of the sheet 201 based on the type of the sheet 201 that is specified in the print job at the time of the printing.

The printer unit 130 feeds the sheet 201 from any of the feeding trays 251 to 254 and the manual feeding tray 250, and transfers the toner attached on the photosensitive drums 223 to 226 onto the sheet 201. Then, the printer unit 130 conveys the sheet 201 with the toner transferred thereon to the fixing device 233 to fix the toner onto the sheet 201 by heat and a pressure, and discharges the sheet 201 conveyed through the fixing device 233 onto a discharge tray 236 by conveyance rollers 234 and 235.

The controller unit 110 detects a length of the sheet 201 in a sub scanning direction in the course of feeding and conveying the sheet 201 from the feeding tray 251, 252, 253, or 254, or the manual feeding tray 250, thereby acquiring an actual size of the sheet 201 fed from this tray.

The present exemplary embodiment has been described assuming that this embodiment uses the color printer including the four photosensitive drums 223 to 226 and the four developing units 227 to 230, but the present invention can be also applied to a monochrome printer including a single photosensitive drum and a single developing unit. Further, the present exemplary embodiment has been described as the configuration that prints the image onto the sheet 201 by the electrophotographic method. However, the present exemplary embodiment may employ, for example, the inkjet method, or may employ another method (e.g., the thermal transfer method), as long as the employed method enables the MFP 100 to print the image.

Next, details of the print job will be described. The print job is input from the PC 101 into the MFP 100 with use of a printing function of an arbitrary application, the printer driver, or the like. In the following description, the present exemplary embodiment will be described assuming that the print job is input with use of the printer driver.

Figure 4:
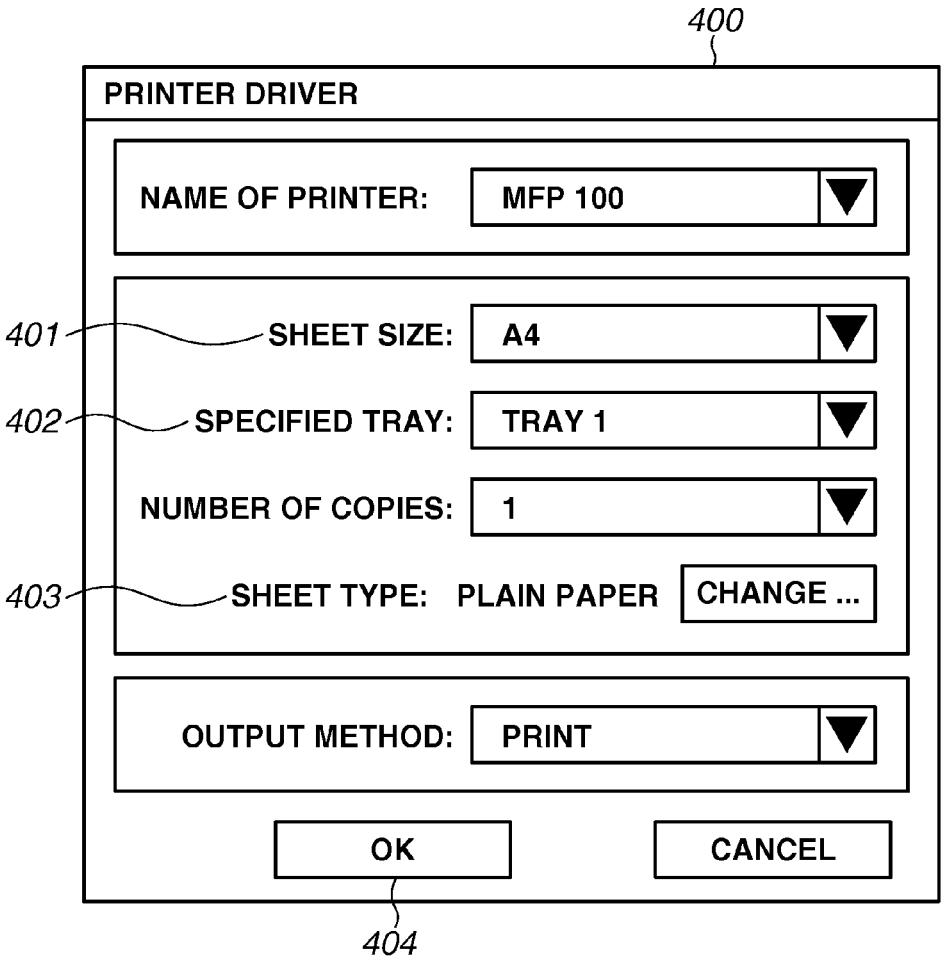
FIG. 4 illustrates a screen according to a first exemplary embodiment.

For example, the user can specify a print setting (e.g., a sheet size 401, a specified tray 402, a sheet type 403) on a printer driver screen 400 illustrated in FIG. 4, which is displayed on a display unit (not illustrated) of the PC 101.

Examples of the sheet size 401 that the user can specify with use of the printer driver screen 400 include "A5", "B5", "A4", "B4", "A3", "B3", "letter", and "legal".

Further, examples of the sheet type 403 that the user can specify with use of the printer driver screen 400 include "plain paper", "thick paper", "thin paper", "coated paper", "glossy paper", "fine quality paper", and "colored paper".

Further, examples of the specified tray 402 that the user can specify with use of the printer driver screen 400 include a "tray 1", a "tray 2", a "tray 3", a "tray 4", a "manual feeding tray", and "automatic (no tray is specified)". For example, when the "tray 1" is selected by the user, the MFP 100 is set to feed the sheet 201 to be used in the printing from the feeding tray 251. On the other hand, for example, when the "manual feeding tray" is selected by the user, the MFP 100 is set to feed the sheet 201 to be used in the printing from the manual feeding tray 250. On the other hand, for example, when "automatic (no tray is specified)" is selected by the user, the MFP 100 is set to feed the sheet 201 from a tray for which the sheet size 701 matching the sheet size 401 specified in the print job is registered as the setting value.

Then, by the user pressing an OK button 404 on the printer driver screen 400, a setting content specified by a function of specifying a print format that is provided by the printer driver is reflected, and the print data such as the PDL data is generated. Then, the print job is transmitted from the PC 101 to the MFP 100 via the network such as the LAN 102.

In the first exemplary embodiment, the CPU 111 of the controller unit 110 acquires the size 401 of the sheet that is specified in the print job (e.g., specified by the printer driver). Further, the CPU 111 refers to the tray setting table 700 stored in the HDD 150 to acquire the registered size of the sheet 201 held in the tray 250, 251, 252, 253, or 254 that is used in the print job as the attribute value of the sheet size 701 in the tray setting table 700.

Further, the CPU 111 sets causing the MFP 100 to carry out printing if the sheet size 401 specified in the print job matches the registered size of the sheet 201 held in the tray 250, 251, 252, 253, or 254 that is used in the print job while associating this setting with the tray 250, 251, 252, 253, or 254 that is used in the print job before the MFP 100 carries out printing. Alternatively, the CPU 111 sets causing the MFP 100 to carry out printing without determining whether the sheet size 401 specified in the print job matches the registered size of the sheet 201 held in the tray 250, 251, 252, 253, or 254 that is used in the print job while associating this setting with the tray 250, 251, 252, 253, or 254 that is used in the print job before the MFP 100 carries out printing. Then, the CPU 111 controls the printing according to this setting associated with the tray 250, 251, 252, 253, or 254 that is used in the print job.

In the following description, details thereof will be described.

In the following description, the present exemplary embodiment will be described regarding an operation when whether to carry out printing with priority placed on the print setting set by the user on the above-described printer driver screen 400 (hereinafter, referred to as a driver setting) (ON/OFF) is set in advance while this setting is associated with the tray(s) 250, 251, 252, 253, and/or 254, tray by tray.

When the setting of carrying out printing with priority placed on the driver setting is set to ON (hereinafter, abbreviated as "driver priority ON"), the MFP 100 carries out printing based on the sheet size 401 and the sheet type 403 specified in the print job (i.e., specified by the printer driver). In other words, the MFP 100 carries out printing assuming that the sheet corresponding to the sheet size 401 and the sheet type 403 specified in the print job is held in the tray 250, 251, 252, 253, or 254 that is used in the print job (hereinafter, referred to as "forcible printing").

If the user is aware of the size and the type of the sheet 201 held in the tray 250, 251, 252, 253, or 254 (for example, if the user has replaced the sheet 201 held in the tray 250, 251, 252, 253, or 254 that is used, before the MFP 100 carries out printing), the user can just set the MFP 100 to "driver priority ON" while associating this setting with the tray(s) 250, 251, 252, 253, and/or 254, tray by tray. For example, suppose that the user specifies "A3, plain paper, and the tray 1" by the printer driver, and inputs the print job into the MFP 100. Further, suppose that the user is aware that "A3 and plain paper" is held in the tray 251 (the tray 1). On the other hand, suppose that the setting values of the tray 251 (the tray 1) are not registered as "A3 and plain paper" but are registered as "A4 and plain paper". In this case, the user sets the MFP 100 to "driver priority ON" while associating this setting with the tray 251 (the tray 1). As a result, the user can cause MFP 100 to carry out printing by feeding the sheet 201 from the tray 251 based on "A3 and plain paper" specified in the print job regardless of the setting values of the tray 251 that is used in the print job.

On the other hand, when the setting of carrying out printing with priority placed on the driver setting is set to OFF (hereinafter, abbreviated as "driver priority OFF"), the MFP 100 carries out printing based on the setting values of the tray 250, 251, 252, 253, or 254 that is used in the print job (the sheet size 701 and the sheet type 702) (hereinafter, referred to as a "normal print mode").

If the user is not aware of the size and the type of the sheet 201 held in the tray 250, 251, 252, 253, or 254, the user can just set the MFP 100 to "driver priority OFF" while associating this setting with the tray(s) 250, 251, 252, 253, and/or 254, tray by tray. When the MFP 100 is set to "driver priority OFF", the MFP 100 does not carry out printing by feeding the sheet 201 from the tray 250, 251, 252, 253, or 254 that is used, if the sheet size 401 and the sheet type 403 specified in the print job do not match the sheet size 701 and the sheet type 702 registered as the setting values of the tray 250, 251, 252, 253, or 254 that is used.

Figure 5:
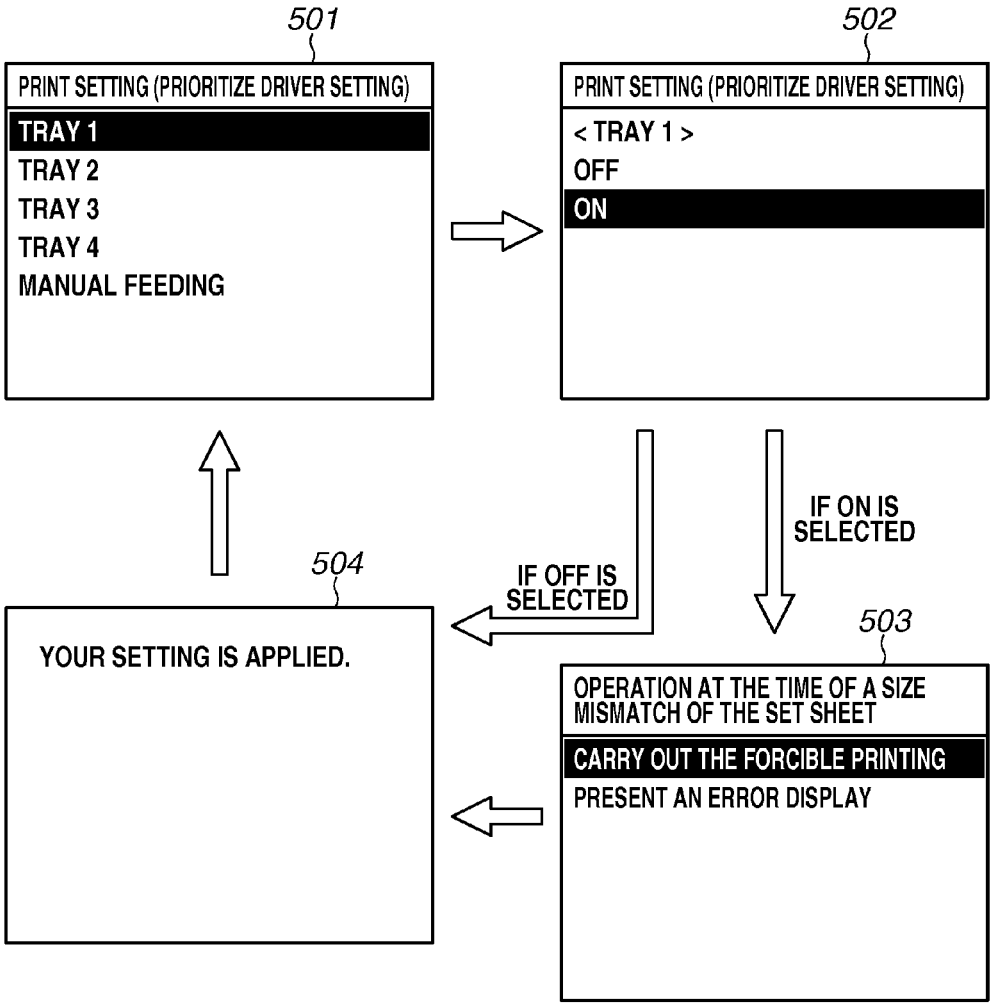
FIG. 5 illustrates screens according to the first exemplary embodiment.

Settings that will be described below are configured with use of setting screens 501 to 504 illustrated in FIG. 5, which are displayed on the display unit 301. The settings that will be described below may be configured with use of the above-described printer driver screen 400.

First, the user arbitrarily selects a tray (the feeding tray 251, 252, 253, or 254, or the manual feeding tray 250) for which the user will set whether to carry out printing with priority placed on the driver setting, with use of the setting screen 501 displayed on the display unit 301. For example, the user selects the feeding tray 251 (the tray 1) on the setting screen 501. Then, the setting screen 502 is displayed on the display unit 301 according to a selection of any of the trays 250 to 254 with use of the setting screen 501.

Subsequently, the user selects "driver priority ON" or "driver priority OFF" while associating this setting with the tray 250, 251, 252, 253, or 254 selected on the setting screen 501 with use of the setting screen 502. Then, the setting screen 503 is displayed on the display unit 301 according to a selection of "driver priority ON" with use of the setting screen 502. On the other hand, the setting screen 504 is displayed on the display unit 301 according to a selection of "driver priority OFF" with use of the setting screen 502.

Setting information about whether to carry out printing with priority placed on the driver setting that is set with use of the setting screen 502 is registered in the format of the tray setting table 700 illustrated in FIG. 7 (column 704), and is stored in the HDD 150.

Subsequently, the user can select any of "carry out the forcible printing" or "present an error display", which will be described below, with use of the setting screen 503.

When "carry out the forcible printing" is selected with use of the setting screen 503, the MFP 100 carries out printing according to the sheet size 401 specified in the print job regardless of the size of the sheet 201 fed from the tray 250, 251, 252, 253, or 254 that is used in the print job (hereinafter, referred to as a "forcible print mode").

In the following description, the present exemplary embodiment will be described assuming that, when the forcible print mode is set, the MFP 100 carries out printing according to the sheet size 401 specified in the print job regardless of the size of the sheet 201 fed from the tray 250, 251, 252, 253, or 254 that is used in the print job. However, the forcible print mode is not limited to this example. The MFP 100 may acquire the size of the sheet 201 fed from the tray 250, 251, 252, 253, or 254 that is used in the print job, and determine whether the sheet size 401 specified in the print job matches the size of the sheet 201 fed from the tray 250, 251, 252, 253, or 254 that is used in the print job.

In this case, the MFP 100 may be configured to carry out printing regardless of whether the sheet size 401 specified in the print job matches the size of the sheet 201 fed from the tray 250, 251, 252, 253, or 254 that is used in the print job. Alternatively, a limitation may be further imposed in such a manner that the MFP 100 should continue the printing only if the size of the sheet 201 fed from the tray 250, 251, 252, 253, or 254 that is used in the print job is the same as or larger than the sheet size 401 specified in the print job. The reason therefor is as follows. When the size of the sheet 201 fed from the tray 250, 251, 252, 253, or 254 that is used in the print job is smaller than the sheet size 401 specified in the print job, the image printed on the sheet 201 is partially cut off, so that a printout desired by the user may be unable to be acquired. On the other hand, when the size of the sheet 201 fed from the tray 250, 251, 252, 253, or 254 that is used in the print job is the same as or larger than the sheet size 401 specified in the print job, the image printed on the sheet 201 is never partially cut off.

The MFP 100 may compare the size of the sheet 201 fed from the tray 250, 251, 252, 253, or 254 that is used in the print job and the sheet size 401 specified in the print job by, for example, calculating a ratio based on lengths of long sides of the individual sheets. Alternatively, the MFP 100 may make this comparison by, for example, calculating a ratio based on lengths of short sides of the individual sheets. Alternatively, the MFP 100 may make this comparison by, for example, calculating a ratio based on areas of the individual sheets.

On the other hand, when "present an error display" is selected with use of the setting screen 503, the MFP 100 stops printing if the size of the sheet 201 fed from the tray 250, 251, 252, 253, or 254 that is used in the print job does not match the sheet size 401 specified in the print job (hereinafter, referred to as "at the time of a size mismatch"). Then, the MFP 100 displays an error screen 600 illustrated in FIG. 6A on the display unit 301 (hereinafter, referred to as an "error display mode").

The MFP 100 notifies the user of, for example, a message "the printing is stopped" with use of the error screen 600. The MFP 100 stops printing because the printout desired by the user may be unable to be acquired due to the mismatch between the size of the sheet 201 fed from the tray 250, 251, 252, 253, or 254 that is used in the print job and the sheet size 401 specified in the print job. The MFP 100 may display a selection screen 610 illustrated in FIG. 6B, instead of displaying the error screen 600 on the display unit 301, in a state of stopping printing due to the size mismatch. The selection screen 610 allows the user to select any of "continue the printing (YES)" and "do not continue the printing (NO)". Setting information about the operation at the time of the size mismatch that is set with use of the setting screen 503 is registered in the format of the tray setting table 700 illustrated in FIG. 7 (column 705), and is stored in the HDD 150.

The setting screen 504 is displayed on the display unit 301 according to a selection of any of "carry out the forcible printing (the forcible print mode)" and "present an error display (the error display mode)" with use of the setting screen 503. The setting screen 504 is a screen for notifying the user of completion of a series of settings regarding whether to carry out printing with priority placed on the driver setting.

Next, details of a series of processes for receiving the print job and carrying out the received print job in the MFP 100 according to the first exemplary embodiment will be described with reference to a flowchart illustrated in FIG. 8. The CPU 111 of the controller unit 110 executes the control program read out from the ROM 115 or the HDD 150 and loaded into the RAM 114, by which these processes are performed.

In step S801, the CPU 111 determines whether the print job is received via the external I/F 140. The print job is input by, for example, the printer driver from the PC 101 into the MFP 100 via the LAN 102, by which the MFP 100 receives the print job.

If the CPU 111 determines that the print job is received (YES in step S801), the processing proceeds to step S802. On the other hand, the process of step S801 is repeated until the CPU 111 determines that the print job is received.

In step S802, the CPU 111 analyzes the print setting of the print job received in step S801 to acquire the print setting. Then, the processing proceeds to step S803. Examples of the print setting acquired in step S802 include the sheet size 401, the specified tray 402, and the sheet type 403 specified in the print job.

In step S803, the CPU 111 determines whether any tray is specified as the tray that is used in the print job. If the CPU 111 determines that some tray is specified as the tray that is used in the print job (some tray is specified) (YES in step S803), the processing proceeds to step S900. On the other hand, if the CPU 111 determines that no tray is specified (NO in step S803), the processing proceeds to step S1000.

In step S900, the CPU 111 performs print processing prepared for printing when some tray is specified as the tray that is used in the print job. In the following description, details of a series of processes regarding step S900 will be described with reference to a flowchart illustrated in FIG. 9. The CPU 111 of the controller unit 110 executes the control program read out from the ROM 115 or the HDD 150 and loaded into the RAM 114, by which these processes are performed.

In step S901, the CPU 111 refers to the tray setting table 700 stored in the HDD 150 to acquire the setting information of the tray 250, 251, 252, 253, or 254 specified in the print job. Then, the processing proceeds to step S902. The setting information acquired in step S901 means the sheet size 701, the sheet type 702, the sheet remaining quantity 703, the driver priority setting 704, and the operation at the time of the size mismatch 705.

In step S902, the CPU 111 determines whether the sheet 201 is held in the tray 250, 251, 252, 253, or 254 specified in the print job. If the CPU 111 determines that the sheet 201 is held in this tray (YES in step S902), the processing proceeds to step S903. On the other hand, if the CPU 111 determines the sheet 201 is not held in this tray (NO in step S902), the processing proceeds to step S909.

In step S903, the CPU 111 determines whether the above-described driver priority setting is set to ON with respect to the tray 250, 251, 252, 253, or 254 specified in the print job. If the CPU 111 determines that the driver priority setting is set to ON with respect to this tray (YES in step S903), the processing proceeds to step S904. On the other hand, if the CPU 111 determines that the driver priority setting is set to OFF with respect to this tray (NO in step S903), the processing proceeds to step S907.

In step S904, the CPU 111 determines whether the above-described "forcible print mode" is set with respect to the tray 250, 251, 252, 253, or 254 specified in the print job.

If the CPU 111 determines that the forcible print mode is set with respect to this tray (YES in step S904), the processing proceeds to step S905. On the other hand, if the CPU 111 determines that the forcible print mode is not set with respect to this tray (NO in step S904), the processing proceeds to step S906.

Figure 9:
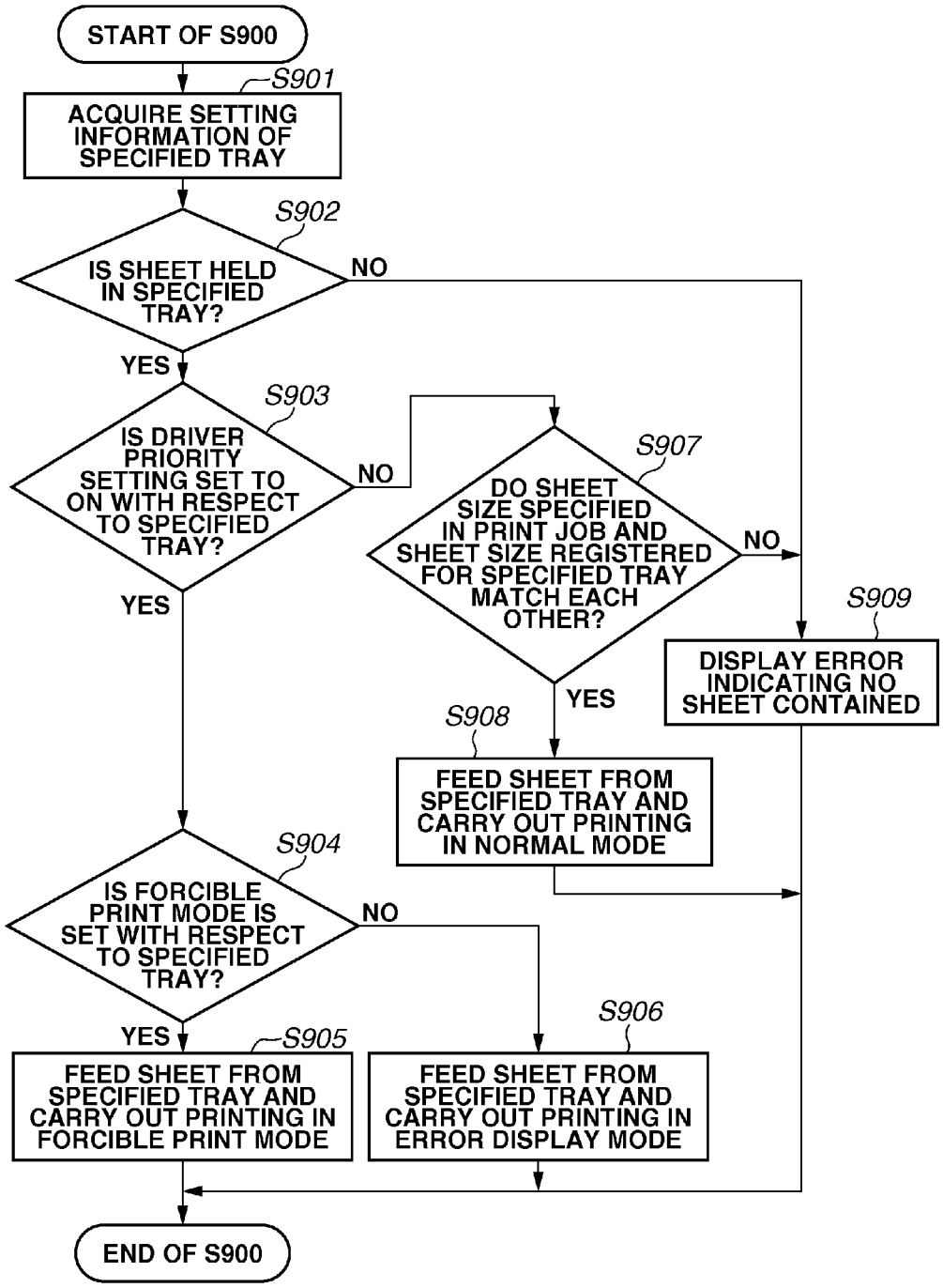
FIG. 9 is a flowchart illustrating an example of control according to the first exemplary embodiment.

In step S905, the CPU 111 instructs the printer unit 130 to feed the sheet 201 from the tray 250, 251, 252, 253, or 254 specified in the print job and carry out printing in the above-described forcible print mode, via the printer control unit 131. After the process of step S905, the series of processes regarding FIG. 9 is ended. Then, the series of processes for receiving the print job and carrying out the received print job is ended.

In step S906, the CPU 111 instructs the printer unit 130 to feed the sheet 201 from the tray 250, 251, 252, 253, or 254 specified in the print job and carry out printing in the above-described error display mode, via the printer control unit 131. More specifically, the CPU 111 acquires the size of the sheet 201 fed from the tray 250, 251, 252, 253, or 254 that is used in the print job. Then, the CPU 111 determines whether the size of the sheet 201 fed from the tray 250, 251, 252, 253, or 254 that is used in the print job matches the sheet size 401 specified in the print job. Then, if the CPU 111 determines that the size of the fed sheet 201 does not match the specified sheet size 401, the CPU 111 notifies the user of, for example, the message "the printing is stopped" with use of the error screen 600. Then, after the process of step S906, the series of processes regarding FIG. 9 is ended. Then, the series of processes for receiving the print job and carrying out the received print job regarding FIG. 8 is ended.

In step S907, the CPU 111 determines whether the sheet size 401 specified in the print job and the sheet size 701 registered for the tray 250, 251, 252, 253, or 254 specified in the print job match each other. In step S907, the CPU 111 may further determine whether the sheet type 403 specified in the print job and the sheet type 702 registered for the tray 250, 251, 252, 253, or 254 specified in the print job match each other.

If the CPU 111 determines that the specified sheet size 401 and the registered sheet size 701 match each other (YES in step S907), the processing proceeds to step S908. On the other hand, if the CPU 111 determines that the specified sheet size 401 and the registered sheet size 701 do not match each other (NO in step S907), the processing proceeds to step S909.

In step S908, the CPU 111 instructs the printer unit 130 to feed the sheet 201 from the tray 250, 251, 252, 253, or 254 specified in the print job and carry out printing in the above-described normal mode, via the printer control unit 131. After the process of step S908, the series of processes regarding FIG. 9 is ended. Then, the series of processes for receiving the print job and carrying out the received print job regarding FIG. 8 is ended.

Figure 11:
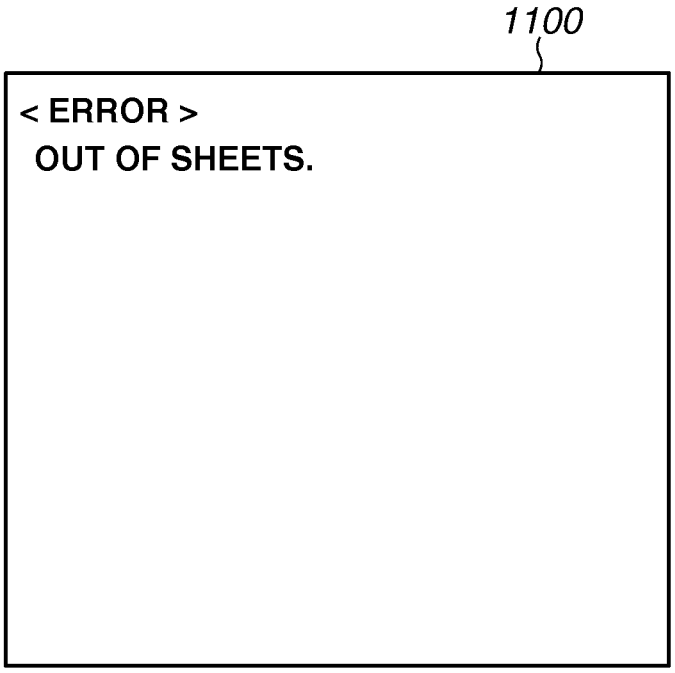
FIG. 11 illustrates a screen according to the first exemplary embodiment.

In step S909, the CPU 111 displays an error screen 1100 illustrated in FIG. 11 on the display unit 301. The CPU 111 notifies the user of, for example, a message "out of sheets" with use of the error screen 1100. This means that the sheet size 401 specified in the print job and the sheet size 701 registered for the tray 250, 251, 252, 253, or 254 specified in the print job do not match each other. After the process of step S909, the series of processes regarding FIG. 9 is ended. Then, the series of processes for receiving the print job and carrying out the received print job regarding FIG. 8 is ended.

The processing regarding step S900 has been described assuming that, if the CPU 111 determines that the above-described driver priority setting is set to ON with respect to the tray 250, 251, 252, 253, or 254 specified in the print job in step S903 (YES in step S903), the processing proceeds to step S904 without proceeding to step S907. However, this processing is not limited to this example. Even if the CPU 111 determines that the driver priority setting is set to ON (YES in step S903), the CPU 111 may further make the determination in step S907. In this case, a desired result can be achieved by arranging the processing regarding step S900 to proceed to step S904 regardless of whether the CPU 111 determines YES or NO in step S907.

In step S1000, the CPU 111 performs print processing prepared for printing when no tray is specified as the tray that is used in the print job. In the following description, details of a series of processes regarding step S1000 will be described with reference to a flowchart illustrated in FIG. 10. The CPU 111 of the controller unit 110 executes the control program read out from the ROM 115 or the HDD 150 and developed into the RAM 114, by which these processes are performed.

In step S1001, the CPU 111 refers to the tray setting table 700 stored in the HDD 150 to acquire the setting information of all of the trays (the feeding trays 251 to 254 and the manual feeding tray 250), and then the processing proceeds to step S1002. The setting information acquired in step S1001 means the sheet size 701, the sheet type 702, the sheet remaining quantity 703, the driver priority setting 704, and the operation at the time of the size mismatch 705.

In step S1002, first, the CPU 111 sets the feeding tray 251 (the tray 1) as a first target tray, and then the processing proceeds to step S1003. Information about the tray set as the first target tray is stored into the HDD 150.

In step S1003, the CPU 111 determines whether the sheet size 401 specified in the print job and the sheet size 701 registered for the first target tray set in step S1002 match each other. In step S1003, the CPU 111 may further determine whether the sheet type 403 specified in the print job and the sheet type 702 registered for the tray registered as the first target tray set in step S1002 match each other.

If the CPU 111 determines that the specified sheet size 401 and the registered sheet size 701 match each other (YES in step S1003), the processing proceeds to step S1004. On the other hand, if the CPU 111 determines that the specified sheet size 401 and the registered sheet size 701 do not match each other (NO in step S1003), the processing proceeds to step S1006.

In step S1004, the CPU 111 determines whether the sheet 201 is held in the first target tray set in step S1002. If the CPU 111 determines that the sheet 201 is held in the first target tray (YES in step S1004), the processing proceeds to step S1005. On the other hand, if the CPU 111 determines that the sheet 201 is not held in the first target tray (NO in step S1004), the processing proceeds to step S1006.

Figure 10:
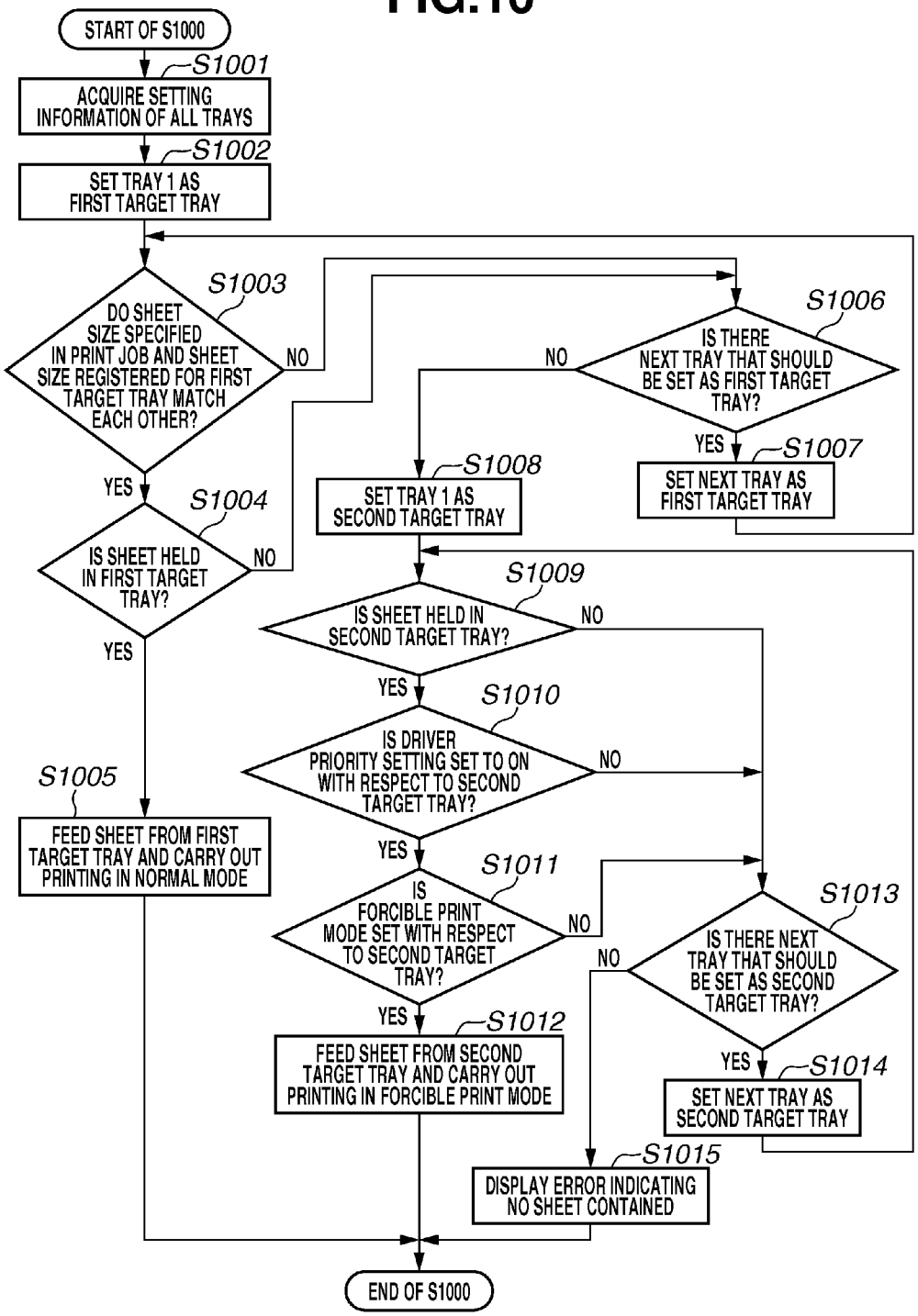
FIG. 10 is a flowchart illustrating an example of control according to the first exemplary embodiment.

In step S1005, the CPU 111 instructs the printer unit 130 to feed the sheet 201 from the first target tray set in step S1002 and carry out printing in the above-described normal mode, via the printer control unit 131. After the process of step S1005, the series of processes regarding FIG. 10 is ended. Then, the series of processes for receiving the print job and carrying out the received print job regarding FIG. 8 is ended.

In step S1006, the CPU 111 determines whether there is a next tray that should be set as the first target tray. For example, when the feeding tray 251 (the tray 1) is set as the first target tray, the next tray that should be set as the first target tray is the "feeding tray 252 (the tray 2)". Further, for example, when the feeding tray 254 (the tray 4) is set as the first target tray, the next tray that should be set as the first target tray is the "manual feeding tray 250".

If the CPU 111 determines that there is the next tray that should be set as the first target tray (YES in step S1006), the processing proceeds to step S1007. On the other hand, if the CPU 111 determines that there is not the next tray that should be set as the first target tray (NO in step S1006), the processing proceeds to step S1008.

In step S1007, the CPU 111 sets the next tray as the first target tray, and then the processing returns to step S1003.

In step S1008, first, the CPU 111 sets the feeding tray 251 (the tray 1) as a second target tray, and then the processing proceeds to step S1009. Information about the tray set as the second target tray is stored into the HDD 150.

In step S1009, the CPU 111 determines whether the sheet 201 is held in the second target tray set in step S1008. If the CPU 111 determines that the sheet 201 is held in the second target tray (YES in step S1009), the processing proceeds to step S1010. On the other hand, if the CPU 111 determines that the sheet 201 is not held in the second target tray (NO in step S1009), the processing proceeds to step S1013.

In step S1010, the CPU 111 determines whether the above-described driver priority setting is set to ON with respect to the second target tray set in step S1008. If the CPU 111 determines that the driver priority setting is set to ON with respect to the second target tray (YES in step S1010), the processing proceeds to step S1011. On the other hand, if the CPU 111 determines that the driver priority setting is set to OFF with respect to the second target tray (NO in step S1010), the processing proceeds to step S1013.

In step S1011, the CPU 111 determines whether the above-described "forcible print mode" is set with respect to the second target tray set in step S1008. If the CPU 111 determines that the "forcible print mode" is set with respect to the second target tray (YES in step S1011), the processing proceeds to step S1012. On the other hand, if the CPU 111 determines that the "forcible print mode" is not set with respect to the second target tray (NO in step S1011), the processing proceeds to step S1013.

In step S1012, the CPU 111 instructs the printer unit 130 to feed the sheet 201 from the second target tray set in step S1008 and carry out printing in the above-described forcible print mode, via the printer control unit 131. After the process of step S1012, the series of processes regarding FIG. 10 is ended. Then, the series of processes for receiving the print job and carrying out the received print job regarding FIG. 8 is ended.

In step S1013, the CPU 111 determines whether there is a next tray that should be set as the second target tray. For example, when the feeding tray 251 (the tray 1) is set as the second target tray, the next tray that should be set as the second target tray is the "feeding tray 252 (the tray 2)". Further, for example, when the feeding tray 254 (the tray 4) is set as the second target tray, the next tray that should be set as the second target tray is the "manual feeding tray 250".

If the CPU 111 determines that there is the next tray that should be set as the second target tray (YES in step S1013), the processing proceeds to step S1014. On the other hand, if the CPU 111 determines that there is not the next tray that should be set as the second target tray (NO in step S1013), the processing proceeds to step S1015.

In step S1014, the CPU 111 sets the next tray as the second target tray, and then the processing returns to step S1009.

In step S1015, the CPU 111 displays the error screen illustrated in FIG. 11 on the display unit 301. The CPU 111 notifies the user of, for example, the message "out of sheets" with use of the error screen 1100. This means that the sheet size 401 specified in the print job does not match the sheet size 701 registered for any of the trays 250 to 254. After the process of step S1015, the series of processes regarding FIG. 10 is ended. Then, the series of processes for receiving the print job and carrying out the received print job regarding FIG. 8 is ended.

Figure 8:
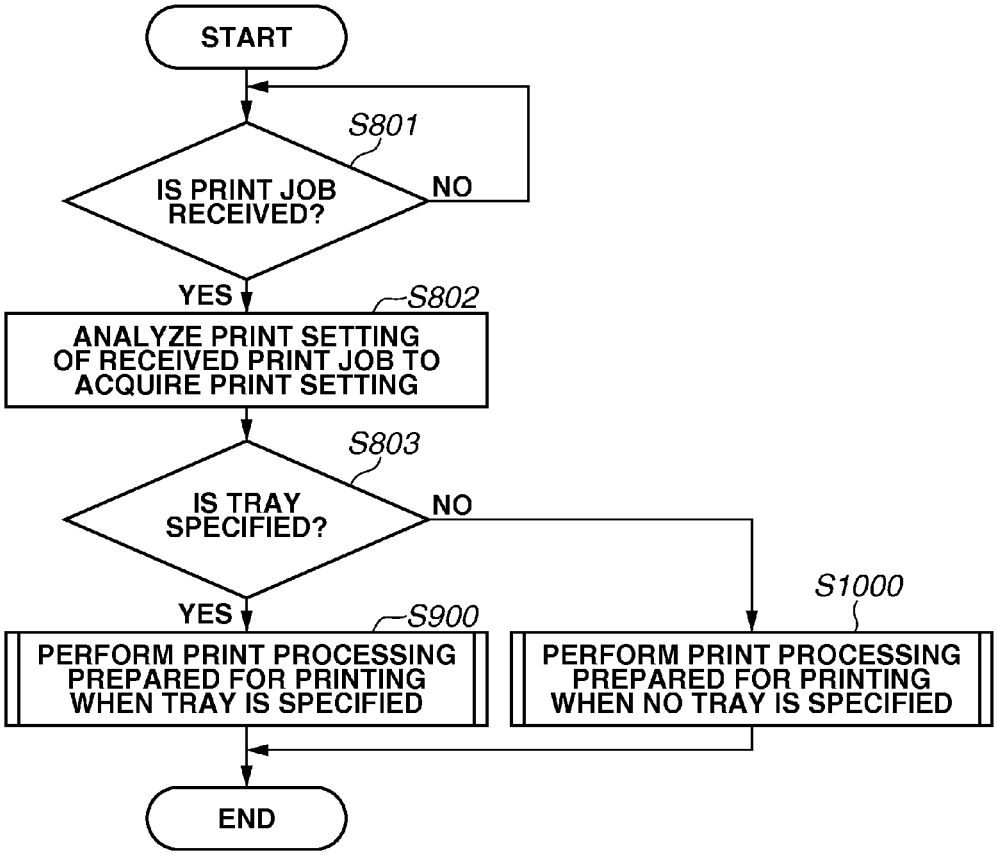
FIG. 8 is a flowchart illustrating an example of control according to the first exemplary embodiment.

This is the details of the series of processes for receiving the print job and carrying out the received print job in the MFP 100 according to the first exemplary embodiment regarding FIG. 8.

The processing regarding step S1000 has been described assuming that, in the above-described steps, steps S1008 to S1014, the CPU 111 determines a single tray with which the MFP 100 should carry out printing in the forcible print mode, and the MFP 100 feeds the sheet 201 from the determined tray and carries out printing in the forcible print mode according to this determination. However, this processing is not limited to this example.

For example, the CPU 111 repeats the processes of steps S1008 to S1014 with respect to all of the trays (the feeding trays 251 to 254 and the manual feeding tray 250), thereby storing trays with which the MFP 100 should carry out printing in the forcible print mode into the HDD 150 as a plurality of candidates. Then, the CPU 111 displays this plurality of candidates stored in the HDD 150 on the display unit 301. The user arbitrarily selects one tray with which the MFP 100 should carry out printing in the forcible print mode from these candidates. Then, the MFP 100 feeds the sheet 201 from the selected tray and carries out printing in the forcible print mode according to the user's selection of the one tray with which the MFP 100 should carry out printing in the forcible print mode. The processing regarding step S1000 may be arranged to be able to be performed in this manner.

Alternatively, the CPU 111 automatically determines one tray for which the sheet size 701 larger than the sheet size 401 specified in the print job is registered, and in which a sheet having a size least different from the sheet size 401 is held, among the plurality of candidates stored in the HDD 150. Then, the MFP 100 feeds the sheet 201 from the determined tray and carries out printing in the forcible print mode according to the automatic determination of the one tray with which the MFP 100 should carry out printing in the forcible print mode. The processing regarding step S1000 may be arranged to be able to be performed in this manner.

As described above, in the first exemplary embodiment to which the present invention is applied, the CPU 111 of the controller unit 110 acquires the size 401 of the sheet that is specified in the print job (for example, specified by the printer driver). Further, the CPU 111 refers to the tray setting table 700 stored in the HDD 150 to acquire the registered size of the sheet 201 held in the tray 250, 251, 252, 253, or 254 that is used in the print job as the attribute value of the sheet size 701 in the tray setting table 700.

Further, the CPU 111 sets causing the MFP 100 to carry out printing if the sheet size 401 specified in the print job matches the registered size of the sheet 201 held in the tray 250, 251, 252, 253, or 254 that is used in the print job while associating this setting with the tray 250, 251, 252, 253, or 254 that is used in the print job before the MFP 100 carries out printing. Alternatively, the CPU 111 sets causing the MFP 100 to carry out printing without determining whether the sheet size 401 specified in the print job matches the registered size of the sheet 201 held in the tray 250, 251, 252, 253, or 254 that is used in the print job while associating this setting with the tray 250, 251, 252, 253, or 254 that is used in the print job before the MFP 100 carries out printing. Then, the CPU 111 can control printing according to this setting associated with the tray 250, 251, 252, 253, or 254 that is used in the print job. In this manner, the user can configure the setting for causing the printing apparatus to carry out printing regardless of whether the size of the sheet that is specified in the print job matches the registered size of the sheet held in the sheet holding unit while associating this setting with the sheet holding unit before the printing apparatus carries out printing. Therefore, the first exemplary embodiment to which the present invention is applied can improve convenience for the user.

The present invention is not limited to the above-described exemplary embodiment and can be modified in various manners (including organic combinations of individual exemplary embodiments) based on the spirit of the present invention, and these modifications and combinations are not excluded from the scope of the present invention.

For example, the present exemplary embodiment has been described as the configuration that receives the print job and carries out the received print job, but the present invention is not limited thereto. The present invention can be also applied even when the copy job, which is one type of the print job, is carried out. More specifically, such an embodiment can be constructed by a configuration that treats the sheet size 401 specified in the print job as being replaced with the size of the document 202 read in the copy job. For example, this embodiment can be constructed by arranging the configuration so as to determine whether the size of the document 202 that is specified in the copy job matches the size of the sheet 201 fed from the tray.

For example, the present exemplary embodiment has been described assuming that the external apparatus is the PC 101 by way of example, but the external apparatus may be the mobile information terminal such as a PDA and a smartphone, a facsimile apparatus, a network connection apparatus, an external dedicated apparatus, or the like.

Further, in the present exemplary embodiment, the CPU 111 of the controller unit 110 of the MFP 100 is the main component performing the above-described various kinds of control, but the MFP 100 may be configured in such a manner that a printing control device such as an external controller prepared in a different housing from the MFP 100 can perform a part or all of the above-described various kinds of control.

Having described various examples and exemplary embodiments of the present invention, it should be appreciated by those skilled in the art that the spirit and the scope of the present invention are never limited to any specific description in the present disclosure.

Other Exemplary Embodiments

The present invention can be also realized by the processing of supplying a program for realizing one or more functions of the above-described exemplary embodiments to a system or an apparatus via a network or a storage medium, and causing one or more processors in a computer of this system or apparatus to read out and execute the program. Further, the present invention can be also realized by a circuit (for example, an application specific integrated circuit (ASIC)) capable of realizing one or more functions.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-143520, filed Jul. 11, 2014, which is hereby incorporated by reference herein in its entirety.

What is claimed is:

1. A printing apparatus comprising:

a storing unit configured to store a size of a sheet, wherein the sheet is held in a sheet holding unit;

a printing unit configured to print an image on the sheet fed from the sheet holding unit based on a size of a sheet that is specified in a print job;

a receiving unit configured to receive, from a user and before the printing unit executes printing, an instruction for notifying the user of an error in a case where the size of the sheet that is specified in the print job does not match the size of the sheet that is stored in the storing unit; and a controlling unit configured to perform control, wherein, in a case where the instruction is received by the receiving unit and the size of the sheet that is specified in the print job does not match the size of the sheet that is stored in the storing unit, the controlling unit is configured to perform control to notify the user of the error and cause the printing unit to execute printing, and wherein, in a case where the instruction is not received by the receiving unit and the size of the sheet that is specified in the print job does not match the size of the sheet that is stored in the storing unit, the controlling unit is configured to perform control to cause the printing unit to execute printing without notifying the user of the error.

2. The printing apparatus according to claim 1, wherein, in a case where the instruction is received by the receiving unit and the size of the sheet that is specified in the print job does not match the size of the sheet that is stored in the storing unit, the controlling unit performs control to cause the printing unit to execute printing according to receiving an instruction for causing the printing unit to execute printing from the user after notifying the user of the error.

3. The printing apparatus according to claim 1, further comprising:

a first sheet holding unit; and a second sheet holding unit, wherein the receiving unit is configured to receive the instruction individually for the first sheet holding unit and the second sheet holding unit.

4. The printing apparatus according to claim 1, wherein the printing apparatus is communicatable with an information processing apparatus, and wherein the size of the sheet that is specified in the print job is a size of a sheet that is specified by a printer driver of the information processing apparatus.

5. A printing apparatus comprising:

a printing unit configured to print an image on a sheet fed from a sheet holding unit based on a size of a sheet that is specified in a print job;

a receiving unit configured to receive, from a user and before the printing unit executes printing, an instruction for notifying the user of an error in a case where the size of the sheet that is specified in the print job does not match a size of the sheet fed from the sheet holding unit; and a controlling unit configured to perform control, wherein, in a case where the instruction is received by the receiving unit and the size of the sheet that is specified in the print job does not match the size of the sheet fed from the sheet holding unit, the controlling unit is configured to perform control to notify the user of the error and cause the printing unit to execute printing, and wherein, in a case where the instruction is not received by the receiving unit and the size of the sheet that is specified in the print job does not match the size of the sheet fed from the sheet holding unit, the controlling unit is configured to perform control to cause the printing unit to execute printing without notifying the user of the error.

6. A printing apparatus comprising:

a storing unit configured to store a size of a sheet, wherein the sheet is held in a sheet holding unit;

a printing unit configured to print an image on the sheet fed from the sheet holding unit;

a setting unit configured to set any one of a first print mode, in which the printing unit executes printing in a case where a size of a sheet that is specified in a print job matches the size of the sheet that is stored in the storing unit and the printing unit stops printing in a case where the size of the sheet that is specified in the print job does not match the size of the sheet that is stored in the storing unit, and a second print mode, in which the printing unit executes printing regardless of the size of the sheet that is stored in the storing unit, while associating with the sheet holding unit; and a controlling unit configured to perform control, wherein, in a case where the first print mode is set by the setting unit and the size of the sheet that is specified in the print job matches the size of the sheet that is stored in the storing unit, the controlling unit is configured to perform control to cause the printing unit to execute printing, wherein, in a case where the first print mode is set by the setting unit and the size of the sheet that is specified in the print job does not match the size of the sheet that is stored in the storing unit, the controlling unit is configured to perform control to cause the printing unit to stop printing, and wherein, in a case where the second print mode is set by the setting unit, the controlling unit is configured to perform control to cause the printing unit to execute printing regardless of the size of the sheet that is stored in the storing unit.

7. The printing apparatus according to claim 6, wherein, in a case where the first print mode is set by the setting unit and the size of the sheet that is specified in the print job does not match the size of the sheet that is stored in the storing unit, the controlling unit notifies a user of an error.

8. The printing apparatus according to claim 6, wherein, in a case where the first print mode is set by the setting unit and the size of the sheet that is specified in the print job does not match the size of the sheet that is stored in the storing unit, the controlling unit performs control to cause the printing unit to execute printing according to receiving an instruction for causing the printing unit to execute printing from a user after notifying the user of an error.

9. The printing apparatus according to claim 6, further comprising a determining unit configured to determine whether the size of the sheet that is specified in the print job matches the size of the sheet that is stored in the storing unit, wherein, in a case where the first print mode is set by the setting unit and the size of the sheet that is specified in the print job is determined to match the size of the sheet that is stored in the storing unit by the determining unit, the controlling unit performs control to cause the printing unit to execute printing, wherein, in a case where the first print mode is set by the setting unit and the size of the sheet that is specified in the print job is determined not to match the size of the sheet that is stored in the storing unit by the determining unit, the controlling unit performs control to cause the printing unit to stop printing, and wherein, in a case where the second print mode is set by the setting unit, the controlling unit performs control to cause the printing unit to execute printing without the determining unit making the determination.

10. The printing apparatus according to claim 6, further comprising a plurality of sheet holding units, wherein the setting unit sets any one of the first print mode and the second print mode while associating with at least one of the plurality of sheet holding units individually.

11. The printing apparatus according to claim 6, wherein the setting unit sets any one of the first print mode and the second print mode before the printing unit executes printing.

12. A printing apparatus comprising:

a printing unit configured to print an image on a sheet fed from a sheet holding unit;

a setting unit configured to set any one of a first print mode, in which the printing unit executes printing in a case where a size of a sheet that is specified in a print job matches a size of the sheet fed from the sheet holding unit and the printing unit stops printing in a case where the size of the sheet that is specified in the print job does not match the size of the sheet fed from the sheet holding unit, and a second print mode, in which the printing unit executes printing regardless of the size of the sheet fed from the sheet holding unit, while associating with the sheet holding unit; and a controlling unit configured to perform control, wherein, in a case where the first print mode is set by the setting unit and the size of the sheet that is specified in the print job matches the size of the sheet fed from the sheet holding unit, the controlling unit is configured to perform control to cause the printing unit to execute printing, wherein, in a case where the first print mode is set by the setting unit and the size of the sheet that is specified in the print job does not match the size of the sheet fed from the sheet holding unit, the controlling unit is configured to perform control to cause the printing unit to stop printing, and wherein, in a case where the second print mode is set by the setting unit, the controlling unit is configured to perform control to cause the printing unit to execute printing regardless of the size of the sheet fed from the sheet holding unit.

13. A control method for controlling a printing apparatus having a storing unit configured to store a size of a sheet, wherein the sheet is held in a sheet holding unit, and a printing unit configured to print an image on the sheet fed from the sheet holding unit based on a size of a sheet that is specified in a print job, the control method comprising:

being configured to receive, from a user and before the printing unit executes printing, an instruction for notifying the user of an error in a case where the size of the sheet that is specified in the print job does not match the size of the sheet that is stored in the storing unit; and performing control, wherein, in a case where the instruction is received and the size of the sheet that is specified in the print job does not match the size of the sheet that is stored in the storing unit, performing control includes performing control to notify the user of the error and cause the printing unit to execute printing, and wherein, in a case where the instruction is not received and the size of the sheet that is specified in the print job does not match the size of the sheet that is stored in the storing unit, performing control includes performing control to cause the printing unit to execute printing without notifying the user of the error.

14. A computer readable storage medium storing a program to cause a computer to perform a control method for controlling a printing apparatus having a storing unit configured to store a size of a sheet, wherein the sheet is held in a sheet holding unit, and a printing unit configured to print an image on the sheet fed from the sheet holding unit based on a size of a sheet that is specified in a print job, the control method comprising:

being configured to receive, from a user and before the printing unit executes printing, an instruction for notifying the user of an error in a case where the size of the sheet that is specified in the print job does not match the size of the sheet that is stored in the storing unit; and performing control, wherein, in a case where the instruction is received and the size of the sheet that is specified in the print job does not match the size of the sheet that is stored in the storing unit, performing control includes performing control to notify the user of the error and cause the printing unit to execute printing, and wherein, in a case where the instruction is not received and the size of the sheet that is specified in the print job does not match the size of the sheet that is stored in the storing unit, performing control includes performing control to cause the printing unit to execute printing without notifying the user of the error.

* * * * *